US005219372A

United States Patent [19]

Lee

[11] Patent Number: 5,219,372

[45] Date of Patent: Jun. 15, 1993

[54] DOOR ACCESSORY WITH A HYDRAULIC RETARDING DEVICE

[76] Inventor: Simpson Lee, No. 11, Lane 184, Chung-Hsiao Rd., Pingtung City, Taiwan

[21] Appl. No.: 900,847

[22] Filed: Jun. 18, 1992

[51] Int. Cl.[5] ..... E05F 3/20; E05F 3/04

[52] U.S. Cl. ..... 16/54; 16/62

[58] Field of Search ..... 16/54, 61, 62

[56] References Cited

U.S. PATENT DOCUMENTS

| | | | |
|---|---|---|---|
| 491,898 | 2/1893 | Lowe | 16/54 |
| 2,118,950 | 5/1938 | Stannard | 16/54 |
| 2,166,651 | 7/1939 | Wennmann | 16/54 |
| 2,230,661 | 2/1941 | Wennmann | 16/54 |
| 2,769,195 | 11/1956 | Hanssen | 16/54 |
| 3,004,280 | 10/1961 | Stein | 16/54 |

*Primary Examiner*—Lowell A. Larson
*Assistant Examiner*—Carmine Cuda
*Attorney, Agent, or Firm*—Charles E. Pfund

[57] ABSTRACT

A door accessory, such as a door hinge or a door check, includes a hydraulic retarding device for cushioning the closing action of a door. The hydraulic retarding device has a cylinder body which confines a fluid receiving space to receive hydraulic fluid therein. One end of a piston rod extends into the fluid receiving space and has a valve unit provided thereon. The valve unit includes a piston which is formed with perforations and which forms a clearance with the cylinder body and a valve ring which is loosely sleeved on the piston rod. The piston rod is operably associated with the door movement so that the valve ring does not block the perforations on the piston during a door opening action, thereby permitting faster fluid flow inside the fluid receiving space and providing little or no resistance to the movement of the piston rod, and so that the valve ring blocks the perforations on the piston during a door closing action, thereby permitting fluid to flow only through the clearance so as to retard the movement of the piston rod.

15 Claims, 8 Drawing Sheets

DOOR ACCESSORY WITH A HYDRAULIC RETARDING DEVICE

BACKGROUND OF THE INVENTION

1. Field of the Invention

The invention relates to a door accessory, such as a door hinge or a door check, more particularly to a door accessory with a hydraulic retarding device.

2. Description of the Related Art

The incorporation of a hydraulic retarding device in a door accessory so as to cushion the closing action of a door is known in the art. However, conventional hydraulic retarding devices resist the opening movement of the door, thus making it inconvenient to open the latter.

SUMMARY OF THE INVENTION

Therefore, the objective of the present invention is to provide a door accessory, such as a door hinge or a door check, with a hydraulic retarding device for cushioning the closing action of a door while providing little resistance, if any, to a door opening movement.

Accordingly, the preferred embodiment of a door accessory of the present invention includes a hydraulic retarding device for cushioning the closing action of a door. The hydraulic retarding device has a cylinder body which confines a fluid receiving space to receive hydraulic fluid therein. One end of a piston rod extends into the fluid receiving space and has a valve unit provided thereon. The valve unit includes a piston which is formed with perforations and which forms a clearance with the cylinder body and a valve ring which is loosely sleeved on the piston rod. The piston rod is operably associated with the door movement so that the valve ring does not block the perforations on the piston during a door opening action, thereby permitting faster fluid flow inside the fluid receiving space and providing little or no resistance to the movement of the piston rod, and so that the valve ring blocks the perforations on the piston during a door closing action, thereby permitting fluid to flow only through the clearance so as to retard the movement of the piston rod.

BRIEF DESCRIPTION OF THE DRAWINGS

Other features and advantages of the present invention will become apparent in the following detailed description of the preferred embodiments, with reference to the accompanying drawings, of which.

DETAILED DESCRIPTION OF THE PREFERRED EMBODIMENTS

Figure 1A:
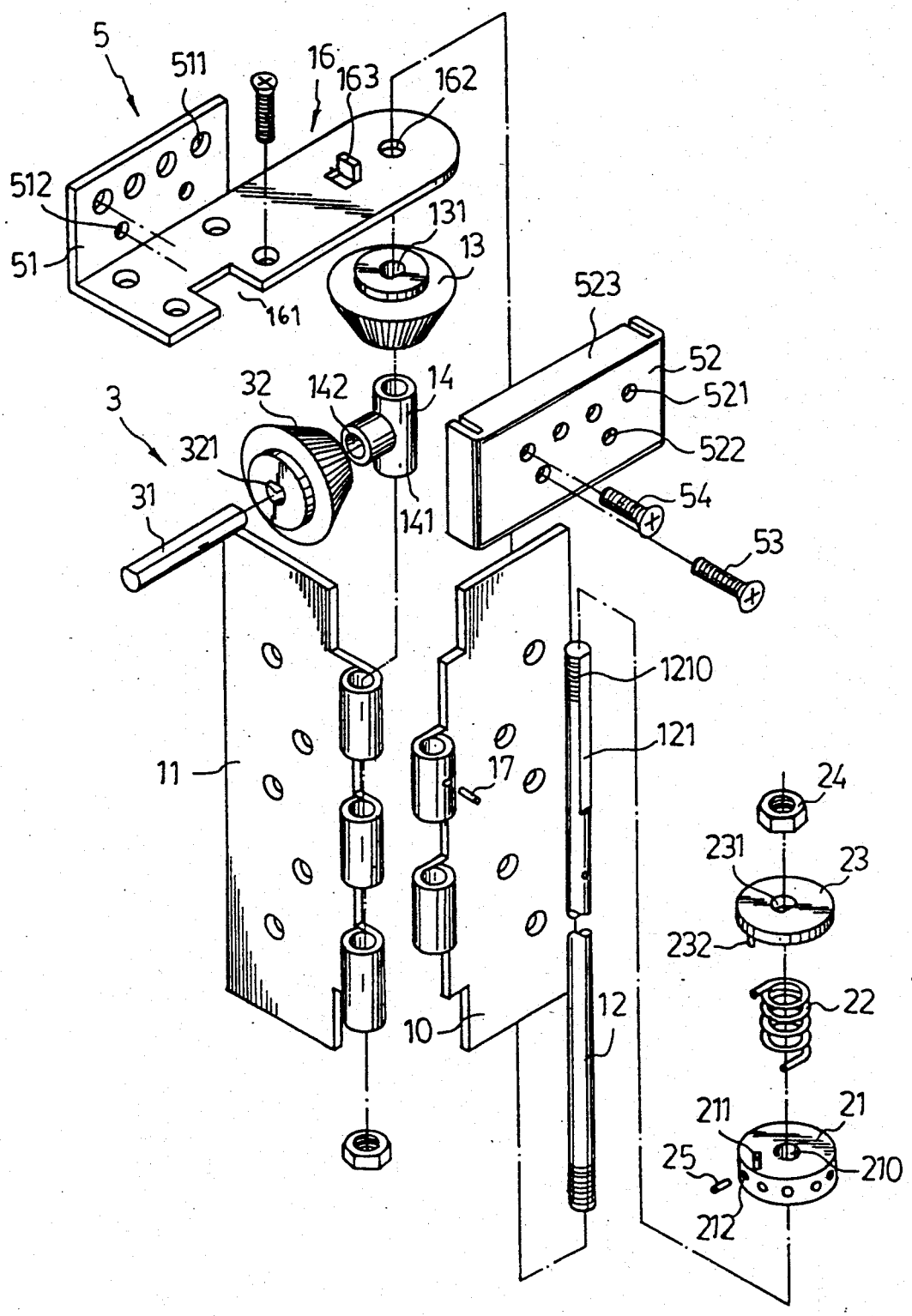
FIGS. 1A and 1B are fragmentary exploded views of the first preferred embodiment of a door accessory according to the present invention.
Figure 1B:
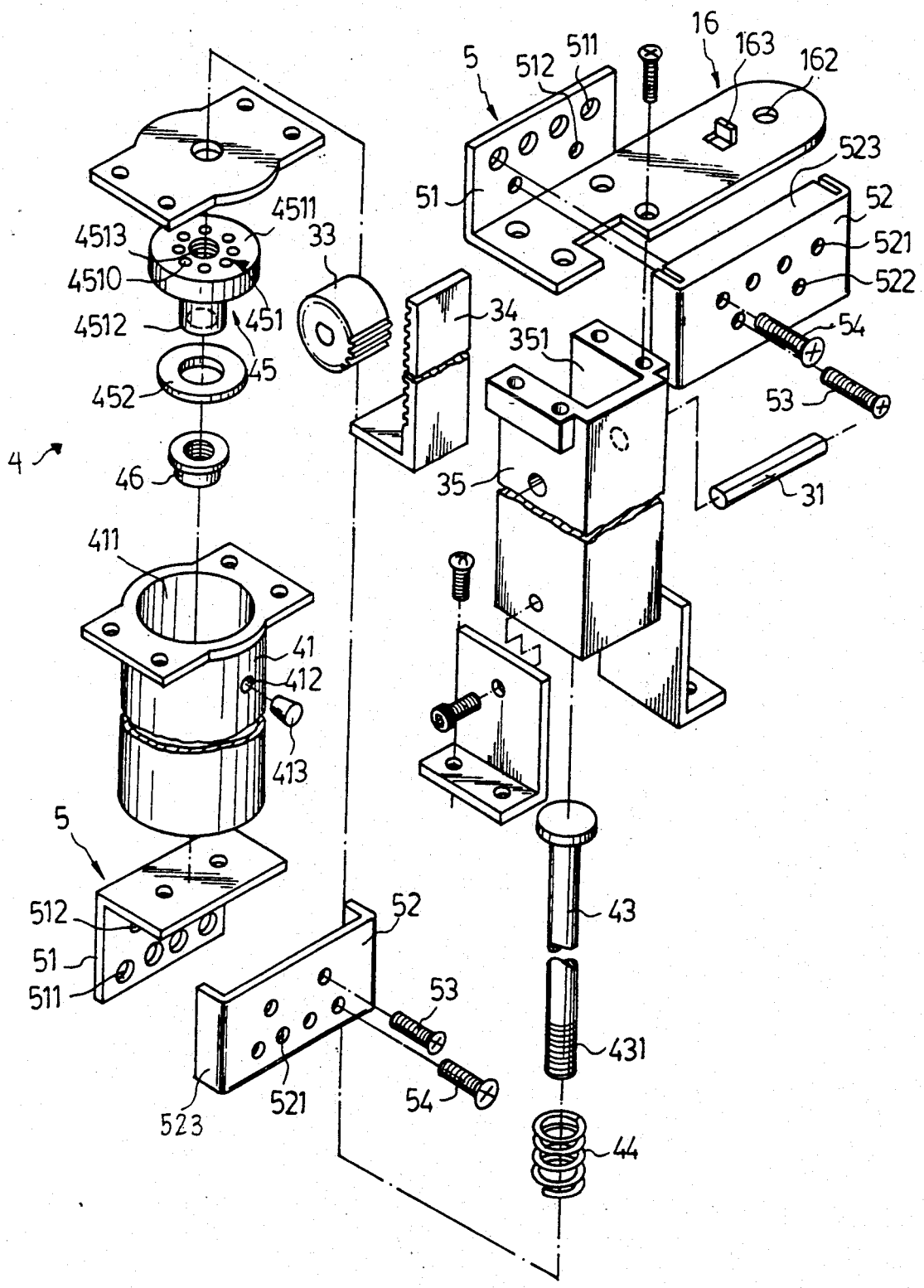
Figure 2:
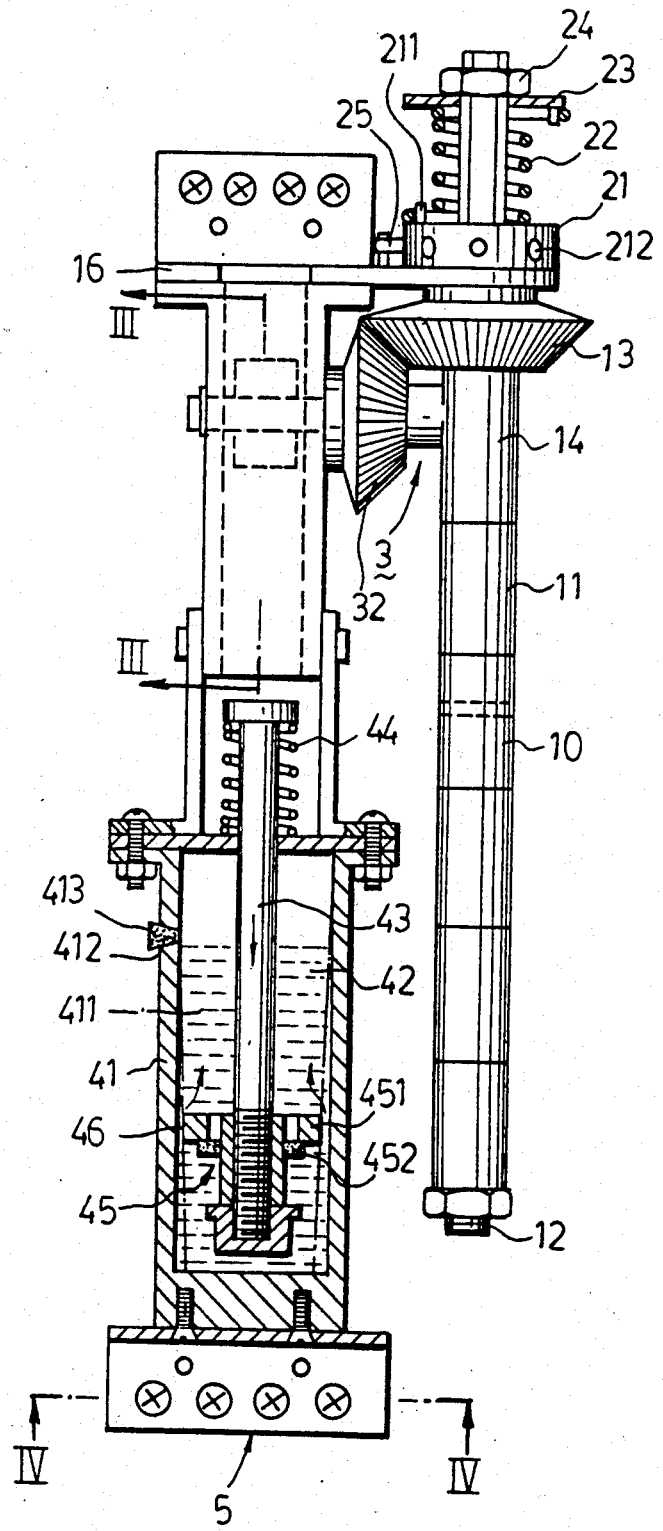
FIG. 2 is an illustration of the first preferred embodiment showing its assembly.
Figure 3:
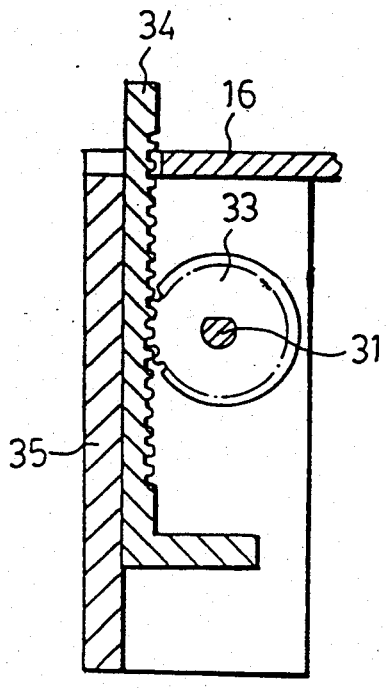
FIG. 3 is a III—III section of FIG. 2.
Figure 4:
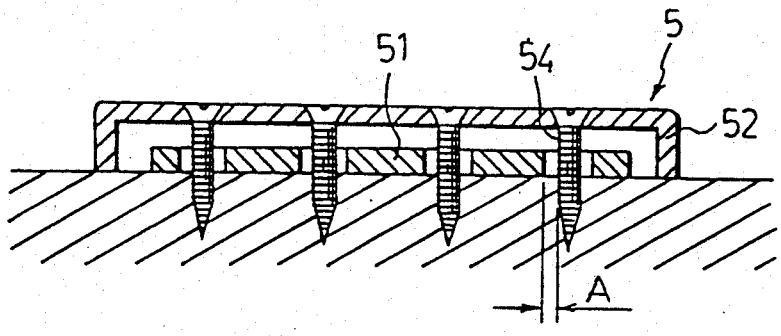
FIG. 4 is a IV—IV section of FIG. 2.
Figure 5:
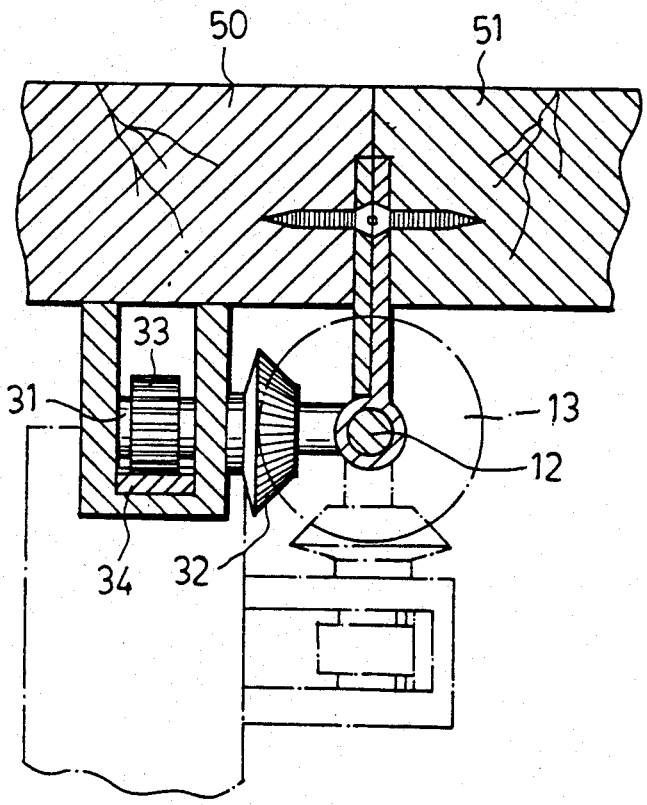
FIG. 5 is a top view of the first preferred embodiment when mounted on a door and door frame.

Referring to FIGS. 1A, 1B and 2, the first preferred embodiment of a door accessory according to the present invention is configured as a door hinge and comprises a stationary hinge leaf (10), a rotatable hinge leaf (11), a hinge pin (12), a static gear (13), a T-shaped tubular connector (14), a torsion spring assembly (2), a rod driving unit (3), a hydraulic retarding device (4) and a pair of mounting units (5).

The hinge leaves (10, 11) have knuckles which are joined together by the hinge pin (12). The stationary hinge leaf (10) is secured on a door frame, while the rotatable hinge leaf (11) is secured on a door. An engaging pin (17) is used to fasten one of the knuckles of the hinge leaf (10) to the hinge pin (12), thereby preventing the rotation of the hinge leaf (10) relative to the hinge pin (12). The upper end portion (121) of the hinge pin (12) has a cross-section which is shaped as a circular segment and further has external screw threads (1210) formed thereon. The static gear (13) is shaped as a truncated cone and is provided with a central hole (131) which has a size and shape that corresponds to the cross-section of the upper end portion (121) of the hinge pin (12). The static gear (13) is provided on the upper end portion (121) and is therefore stationary relative to the hinge pin (12). The tubular connector (14) has an upright tube portion (141) and a transverse tube portion (142) which extends from one side of the upright tube portion (141). The hinge pin (12) extends through the upright tube portion (141). When assembled, the upright tube portion (141) is preferably disposed between the static gear (13) and one of the knuckles of the rotatable hinge leaf (11).

The torsion spring assembly (2) is provided on the upper end portion (121) of the hinge pin (12) and comprises a rotatable collar (21), a torsion spring (22), a stationary collar (23), a nut (24) and a control pin (25). The rotatable collar (21) is a cylindrical body which is formed with an upright through bore (210) for receiving the upper end portion (121) therethrough. The rotatable collar (21) further has a top side provided with an eccentric upright projection (211) and a plurality of radially extending and angularly spaced bores (212). The torsion spring (22) surrounds the upper end portion (121) and has a lower end secured to the upright projection (211). The stationary collar (23) is formed with a central hole (231) which has a size and shape that corresponds to the cross-section of the upper end portion (121) and is provided on the upper end portion (121) on top of the torsion spring (12). The upper end of the torsion spring (22) is secured on a downwardly extending projection (232) which is formed on the stationary collar (23). The nut (24) engages the external screw threads (1210) of the upper end portion (121) so as to retain the collars (21, 23) and the torsion spring (22) thereat. The control pin (25) is inserted into a selected one of the bores (212). The torsion spring assembly (2) provides the force required to close the door when the door is opened.

The rod driving unit (3) comprises an axle (31), a dynamic gear (32), a pinion (33), an upright rack (34) and a guide seat (35). The axle (31) is a circular segment in cross-section and has one end which extends into the transverse tube portion (142) of the tubular connector (14). The dynamic gear (32) is adapted to mesh with the static gear (13), is similarly shaped as a truncated cone and is provided with a central hole (321) which has a size and shape that corresponds to the cross-section of the axle (31). The pinion (33) is axially mounted on the other end of the axle (31) and is rotatably driven by the latter. The pinion (33) engages the rack (34). Referring to FIGS. 1A, 1B, 2 and 3, rotation of the door relative to the door frame causes the dynamic gear (32) to rotate and drive the axle (31) and the pinion (33) into rotation, thereby causing linear vertical movement of the rack (34). The guide seat (35) defines an upright receiving space (351) for movably receiving the pinion (33) and the rack (34) therein.

A horizontally extending cover panel (16) is mounted on an open top end of the guide seat (35) and is longer than the width of the guide seat (35). The cover panel (16) is formed with a notch (161) to permit the rack (34) to extend therethrough and an opening (162) to permit the hinge pin (12) to pass therethrough. The cover panel (16) is provided between the rotatable collar (21) and the static gear (13). The cover panel (16) is further provided with an upright projection (163) adjacent to the opening (162). The control pin (25) abuts with the upright projection (163) so as to rotate the rotatable collar (21) relative to the hinge pin (12) and permit winding of the torsion spring (22) when the door is opened.

The hydraulic retarding device (4) is provided below the guide seat (35) and comprises a cylinder body (41) which receives hydraulic fluid (42) therein, a piston rod (43) which extends into the cylinder body (41), a compression spring (44) which biases the piston rod (43) outwardly of the cylinder body (41) and a valve unit (45) mounted on the piston rod (43) and disposed inside the cylinder body (41).

The cylinder body (41) confines a fluid receiving space (411) and is provided with a radial fluid inlet (412) for injecting hydraulic fluid (42) into the fluid receiving space (411). A resilient plug (413) is provided to block the fluid inlet (412). The lower end of the piston rod (43) is provided with an external thread (431). The valve unit (45) includes a piston (451) and a valve ring (452). The piston (451) has an enlarged head portion (4511) and a tubular shaft portion (4512) which extends axially downward from the head portion (4511). The piston (451) is provided with a threaded central hole (4513) which engages the external thread (431) on the piston rod (43). A nut (46) is secured on the lower end of the piston rod (43) so as to hold the piston (451) in place. The head portion (4511) of the piston (451) is provided with perforations (4510). The valve ring (452) is loosely sleeved on the tubular shaft portion (4512). The periphery of the head portion (4511) forms a clearance (46) with the inner surface of the fluid receiving space (411).

Referring to FIGS. 1A, 1B, 2 and 4, the mounting units (5) are used to secure the first preferred embodiment on a door. The mounting units (5) guard against the improper operation of the first preferred embodiment caused by misalignment between the static gear (13) and the dynamic gear (32) when the first preferred embodiment is installed.

One of the mounting units (5) secures the cover panel (16) onto the door. The other one of the mounting units (5) secures the cylinder body (41) onto the door. Each of the mounting units (5) includes first and second mounting panels (51, 52). The first mounting panel (51) is provided with a row of openings (511) and a row of mounting holes (512). The second mounting panel (52) is similarly formed with a row of openings (521) and a row of mounting holes (522). The openings (521) in the second mounting panel (52) are aligned with and are smaller than the openings (511) in the first mounting panel (51). The mounting holes (522) in the second mounting panel (52) are aligned and are equal in diameter with the mounting holes (512) in the first mounting panel (51). The second mounting panel (52) is provided with a rearward peripheral flange (523) to space apart the first and second mounting panels (51, 52). Screws (53) extend into the mounting holes (512, 522) in the first and second mounting panels (51, 52) so as to secure the first and second mounting panels (51, 52) onto the door. The openings (511, 521) in the first and second mounting panels (51, 52) are aligned at this stage. Screws (54) then extend into the openings (511, 521), and the screws (53) are removed from the first and second mounting panels (51, 52). Because of the difference in the sizes of the openings (511, 521), a gap (A) is formed between the screws (54) and the respective opening (511). The gap (A) permits slight movement of the first mounting panel (51) relative to the second mounting panel (52) so as to facilitate proper alignment between the static and dynamic gears (13, 32) when the first preferred embodiment is installed.

Referring to FIGS 1A, 1B, 2 and 5, the rotatable hinge leaf (11) is secured on a door (50), while the stationary hinge leaf (10) is secured on a door frame (51). The hinge pin (12) joins together the hinge leaves (10, 11). When the door (50) is opened, the upright projection (163) on the cover panel (16) urges the control pin (25) so as to rotate the rotatable collar (21) relative to the stationary collar (23), thereby winding the torsion spring (21) in order to generate the force which is required to move the door (50) back to the closed position. The opening action of the door (50) causes the dynamic gear (32) to rotate relative to the static gear (13) and drive the axle (31) and the pinion (33) to rotate in a first direction to cause linear upward movement of the rack (34). No downward pushing force is exerted on the piston rod (43), thereby allowing the compression spring (44) to expand and force the piston rod (43) to return quickly to its inactivated position.

When the force which was applied so as to open the door (50) has been removed, the torsion spring (22) unwinds to close the door (50). The closing action of the door (50) causes the dynamic gear (32) to rotate relative to the static gear (13) and drive the axle (31) and the pinion (33) to rotate in a second direction to cause linear downward movement of the rack (34), thereby applying a downward pushing force on the piston rod (43) and compressing the spring (44). Downward movement of the piston rod (43) causes corresponding downward movement of the piston (451). The piston (451) applies a downward pressure on the hydraulic fluid (42), thereby causing the hydraulic fluid (42) to apply an upward force on the valve ring (452) to close the perforations (4510) in the piston (451). The flow of hydraulic fluid (42) from a lower side of the piston (451) to an upper side of the latter is permitted only at the clearance (46). This retards the downward movement of the piston rod (43), thereby retarding the closing action of the door (50) to prevent slamming.

Figure 6:
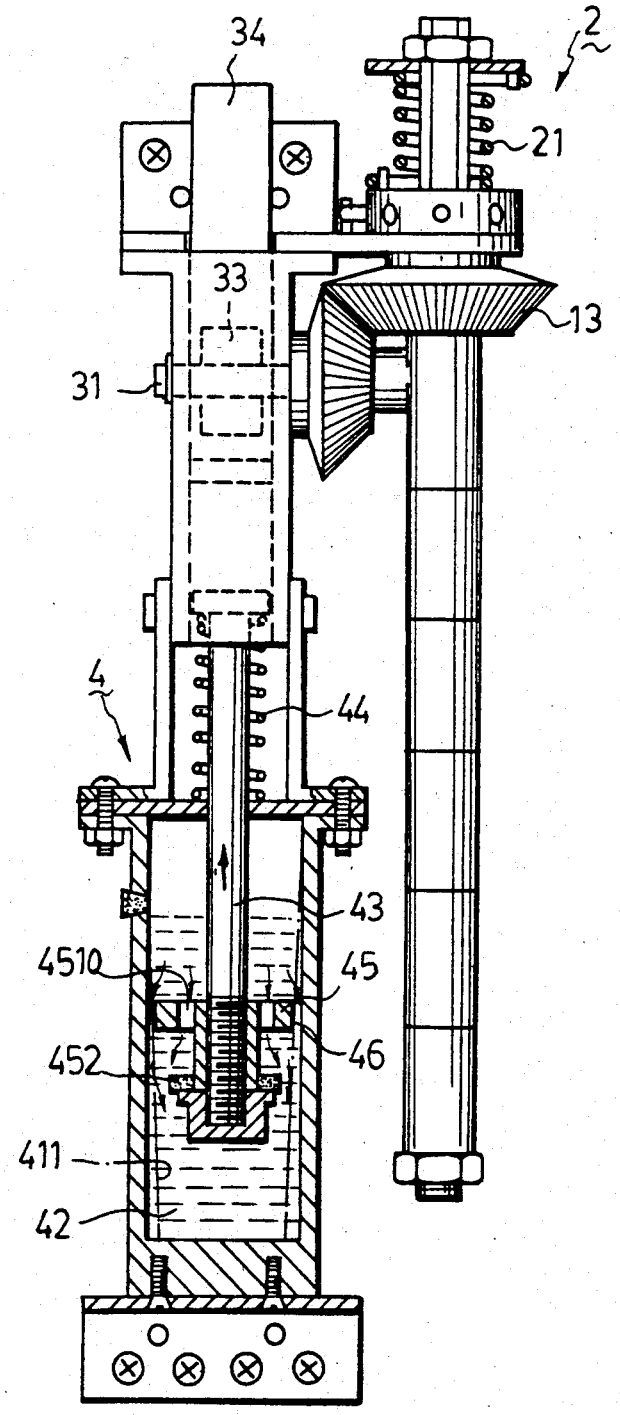
FIG. 6 illustrates the first preferred embodiment during a door opening action.

Referring to FIG. 6, the linear upward movement of the rack (34) when the door (50) is opened allows the compression spring (44) to expand and move the piston rod (43) to the former inactivated position. The piston rod (43) does not resist upward movement of the rack (34), and thus, the hydraulic retarding device (4) does not provide any resistance when the door (50) is opened.

Note that when the piston rod (43) is raised, the piston (451) is correspondingly raised. Hydraulic fluid (42) flows from the upper side of the piston (451) to the lower side of the same to force the valve ring (452) to unblock the perforations (4510). Fluid flow in this direction is therefore faster since hydraulic fluid (42) flows through the clearance (46) and through the perforations (4510) at this stage, thereby permitting a quick return of the piston rod (43) to the inactivated position.

The fluid receiving space (411) of the cylinder body (41) may be configured so as to widen gradually from a lower end to a top end of the same, as indicated by the phantom lines in FIGS. 2 and 6. This permits the hydraulic fluid (42) to exert a larger retarding force during a closing action of the door (50).

Figure 7:
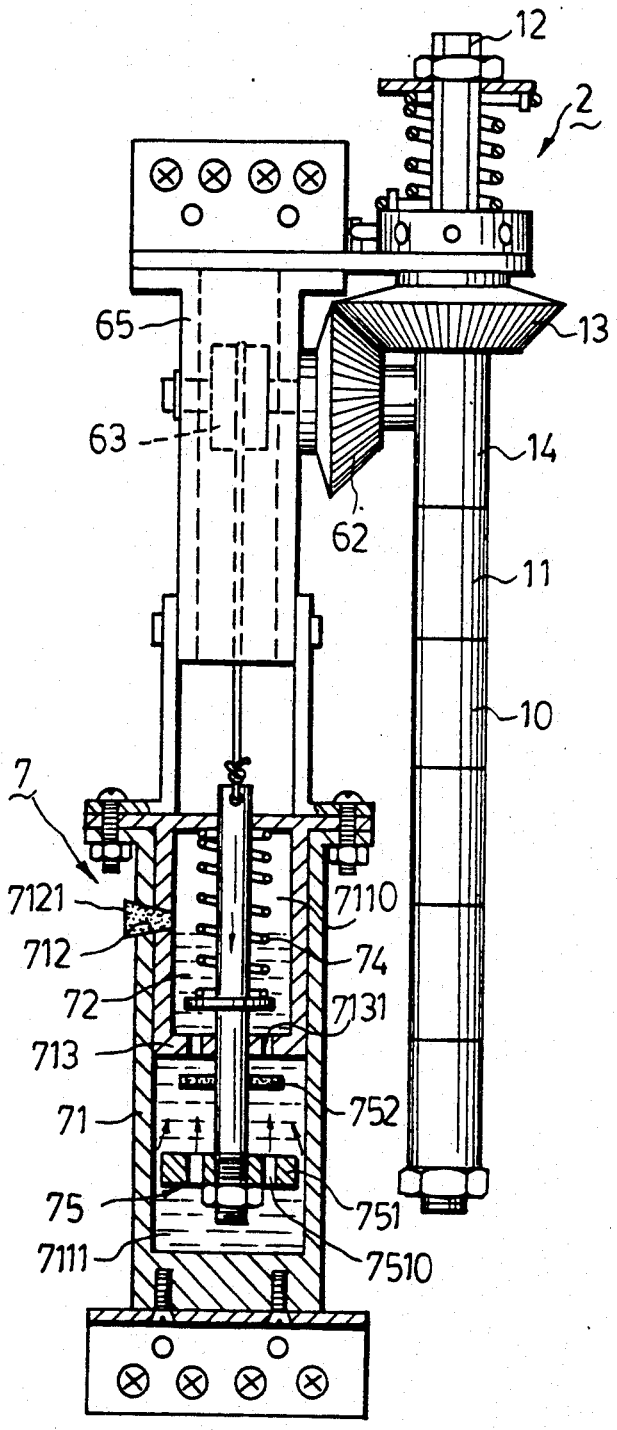
FIG. 7 is an illustration of the second preferred embodiment of a door accessory according to the present invention during a door opening action.
Figure 8:
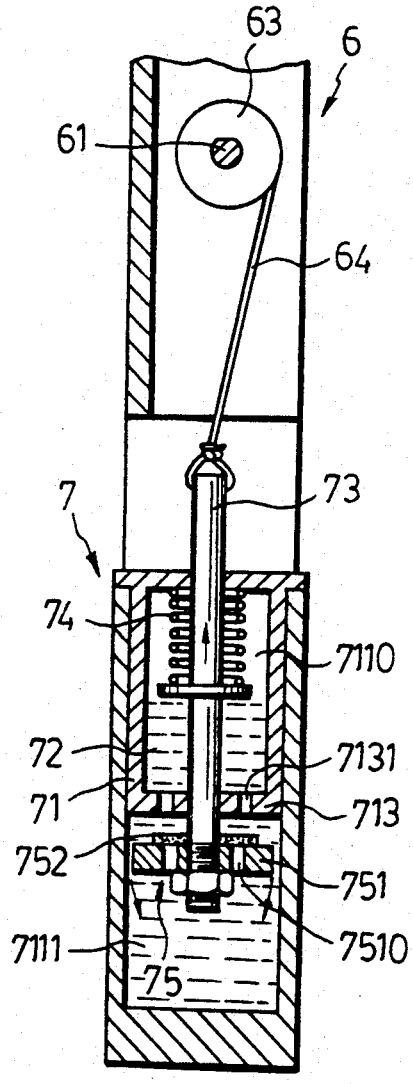
FIG. 8 illustrates the second preferred embodiment during a door closing action.

Referring to FIGS. 7 and 8, the second preferred embodiment of a door accessory according to the present invention is similarly configured as a door hinge and comprises a stationary hinge leaf (10), a rotatable hinge leaf (11), a hinge pin (12), a static gear (13), a T-shaped tubular connector (14), a torsion spring assembly (2), mounting units (5), a rod driving unit (6) and a hydraulic retarding device (7).

Note that like elements are indicated by like reference numerals throughout the specification. The main differences, therefore, between the first and second preferred embodiments reside in the construction of the rod driving units (3, 6) and the hydraulic retarding devices (4, 7). The remaining components of the second preferred embodiment are similar to those in the first preferred embodiment and will not be detailed further.

The rod driving unit (6) comprises an axle (61), a dynamic gear (62), a sheave (63) and a cable (64). The axle (61) is a circular segment in cross-section and has one end which extends into the tubular connector (14). The dynamic gear (62) is adapted to mesh with the static gear (13) and is provided with a central hole which has a size and shape that corresponds to the cross-section of the axle (61). The sheave (63) is axially mounted on the other end of the axle (61) and is rotatably driven by the latter. The cable (64) has one end which is secured on the sheave (63).

The hydraulic retarding device (7) is provided below a guide seat (65) of the rod driving unit (6) and comprises a cylinder body (71) which receives hydraulic fluid (72) therein, a piston rod (73) which extends into the cylinder body (71), a compression spring (74) which biases the piston rod (73) inwardly of the cylinder body (71) and a valve unit (75) mounted on the piston rod (73) and disposed inside the cylinder body (71).

The cylinder body (71) confines a fluid receiving space (711) and is provided with a radial fluid inlet (712) for injecting hydraulic fluid (72) into the fluid receiving space (711). A resilient plug (7121) is provided to block the fluid inlet (712). A partition plate (713) divides the fluid receiving space (711) into upper and lower fluid chambers (7110, 7111). The partition plate (713) has openings (7131) formed thereon. The valve unit (75) includes a piston (751) and a valve ring (752). The piston (751) is provided on a lower end of the piston rod (73) and has perforations (7510) formed therein. The valve ring (752) is loosely sleeved on the piston rod (73) and is disposed between the piston (751) and the partition plate (713).

When a door which incorporates the second preferred embodiment is opened, the dynamic gear (62) rotates relative to the static gear (13) and drives the axle (61) and the sheave (63) to rotate in a first direction, thereby placing the cable (64) in a slackened state. No upward pulling force is exerted on the piston rod (73), thereby allowing the compression spring (74) to expand and force the piston rod (73) to return quickly to its inactivated position. The piston rod (73) is thus lowered, and the piston (751) is correspondingly lowered. A large portion of the hydraulic fluid (72) flows through the perforations (7510) in the piston (751) to move the valve ring (752) away from the piston (752).

Note that the piston rod (73) encounters little resistance when moving in an upward direction. The hydraulic retarding device (7) therefore provides little resistance, if any, when the door is opened.

When the force which was applied so as to open the door has been removed, the torsion spring assembly (2) unwinds to close the door. Closing action of the door causes the dynamic gear (62) to rotate relative to the static gear (13) and drive the axle (61) and the sheave (63) to rotate in a second direction to cause the cable (64) to wind on the sheave (63). The cable (64) pulls the piston rod (73) upward, thereby causing the spring (74) to compress. Upward movement of the piston rod (73) causes corresponding upward movement of the piston (751). The valve ring (752) closes the perforations (7510) in the piston (751), thereby permitting fluid flow only in the clearance formed between the piston (751) and the inner surface of the fluid receiving space (711). This retards the upward movement of the piston rod (73), thereby retarding the closing action of the door to prevent slamming.

Figure 9:
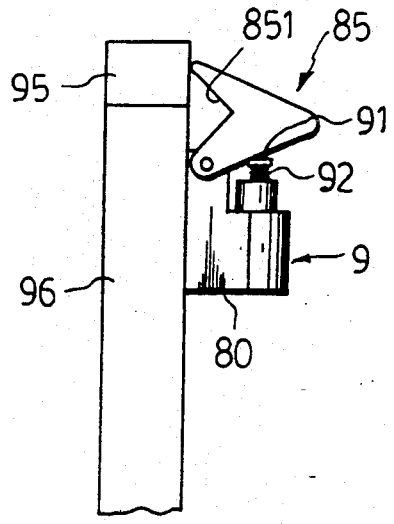
FIGS. 9 and 10 are illustrations of the third preferred embodiment of a door accessory according to the present invention when mounted on a door and door frame.

The third preferred embodiment of a door accessory according to the present invention is shown in FIG. 9 to be configured as a door check. The third preferred embodiment is preferably installed on a door (96), which already incorporates an automatic door closure, so as to prevent the door (96) from slamming onto the door frame (95). The third preferred embodiment comprises a mounting seat (80) secured adjacent to a top end of the door (96), a hydraulic retarding device (9) received in the mounting seat (80), and a hook unit (85). The hydraulic retarding device (9) is configured so that a piston rod (91) thereof descends at a slow pace and ascends at a faster pace. The hydraulic retarding device (9) is similar to the hydraulic retarding device (4) of the first preferred embodiment and will not be detailed further. The hook unit (85) is pivotally mounted on a top end of the mounting seat (80) and is provided with a 90° door engaging face (851). The hook unit (85) is used to activate the piston rod (91) of the hydraulic retarding device (9), as will be detailed in the succeeding paragraphs.

Figure 10:
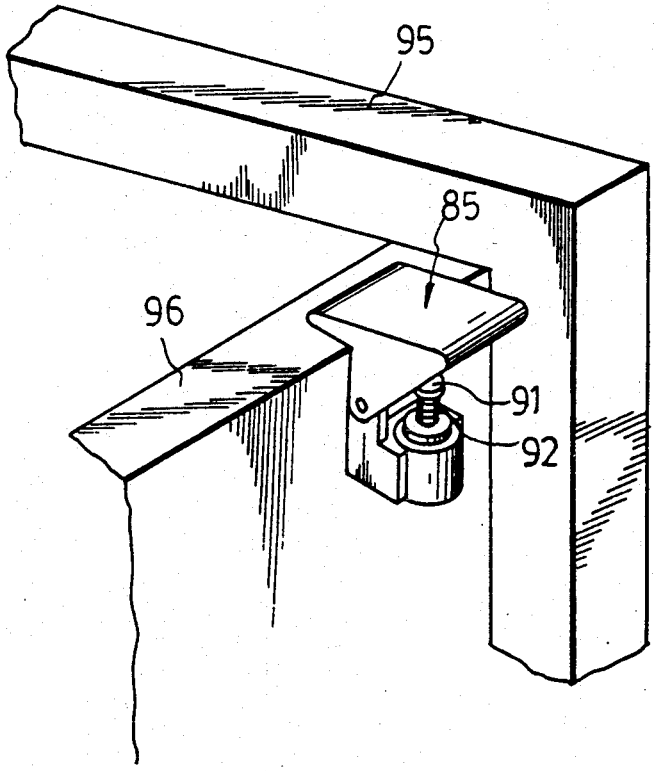

When the door (96) is in a closed position, as shown in FIG. 9, the door frame (95) prevents the hook unit (85) from engaging the top end of the door (96). The hook unit (85) maintains the piston rod (91) in an activated position. Referring to FIG. 10, when the door (96) is opened, the door frame (95) ceases to abut against the hook unit (85), thereby allowing a compression spring (92) of the hydraulic retarding device (9) to expand and move the piston rod (91) upward. Upward movement of the piston rod (91) results in the application of a force on the hook unit (85), which force urges the hook unit (85) to pivot forwardly so that the engaging face (851) is in contact with the door (96).

Closing action of the door (96) causes the door frame (95) to once more abut against the hook unit (85), thereby causing the hook unit (85) to pivot rearwardly so as to apply a downward pushing force on the piston rod (91). The hydraulic retarding device (9) permits a gradual descent of the piston rod (91), thereby retarding the closing action of the door (96) to prevent slamming.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A door accessory, comprising:

a hinge pin;

a stationary hinge leaf fixed to said hinge pin and adapted to be fixed to a door frame;

a rotatable hinge leaf rotatably mounted to said hinge pin and adapted to be fixed to a door;

a static gear mounted axially and being stationary relative to said hinge pin;

a torsion spring assembly mounted on said hinge pin and being wound when the door is moved from a closed position to an open position relative to the door frame so as to provide a force for automatically returning the door back to the closed position;

a rod driving unit including: a gear means meshing with and rotating in a first direction relative to said static gear when the door moves toward the open position and in a second direction when the door moves toward the closed position; and an upright rack engaging said gear means and moving in a vertical upward direction when said gear means rotates in the first direction and in a vertical downward direction when said gear means rotates in the second direction; and a hydraulic retarding device provided below said rod driving unit and including: a cylinder body confining a fluid receiving space to receive hydraulic fluid therein; a piston rod having a lower end extending into said fluid receiving space; a compression spring biasing said piston rod outwardly of said cylinder body; a piston mounted on said piston rod inside said cylinder body and being formed with perforations, said piston forming a clearance with said cylinder body; and a valve ring loosely sleeved on said piston rod below said piston;

said compression spring expanding to move said piston rod upward so that said hydraulic fluid flows through said clearance and through said perforations to separate said valve ring from said piston when said upright rack moves in the upward direction and ceases to apply a downward pushing force on said piston rod;

movement of said upright rack in the downward direction causing said upright rack to contact and apply a downward pushing force on said piston rod, thereby causing said piston to move downward and said valve ring to block said perforations to permit said hydraulic fluid to flow only through said clearance to retard downward movement of said piston rod.

2. The door accessory as claimed in claim 1, wherein:

said rod driving unit further comprises a guide seat which defines an upright receiving space, said upright rack being movably provided in said upright receiving space; and said gear means comprises: an axle extending transverse to said hinge pin; a dynamic gear meshing with said static gear, said dynamic gear being mounted axially and being stationary relative to said axle; and a pinion disposed inside said guide seat and engaging said upright rack, said pinion being mounted axially and being stationary relative to said axle.

3. The door accessory as claimed in claim 2, wherein said gear means further comprises a T-shaped tubular connector having an upright tube portion and a transverse tube portion which extends from said upright tube portion, said hinge pin extending through said upright tube portion, said axle having one end extending into said transverse tube portion.

4. The door accessory as claimed in claim 2, wherein:

said guide seat has an open top end; and said door accessory further comprises a horizontally extending cover panel adapted to be fixed to the door and being mounted on said open top end of said guide seat and being longer than the width of said guide seat, said cover panel being formed with a notch to permit said upright rack to extend therethrough and an opening to permit said hinge pin to extend therethrough, said cover panel being disposed between said torsion spring assembly and said static gear.

5. The door accessory as claimed in claim 4, wherein said torsion spring assembly comprises:

a rotatable collar mounted axially on said hinge pin and rotating with said cover panel relative to said hinge pin when the door is moved;

a stationary collar mounted axially on said hinge pin and being stationary relative to said hinge pin; and a torsion spring surrounding a portion of said hinge pin between said stationary and rotatable collars, said torsion spring having a first end connected to said stationary collar and a second end connected to said rotatable collar;

whereby, said torsion spring is wound when said cover panel and said rotatable collar move with the door away from the closed position.

6. The door accessory as claimed in claim 5, wherein:

said rotatable collar is a cylindrical body which is formed with a plurality of radially extending and angularly spaced bores;

said cover panel is provided with an upright projection adjacent to said rotatable collar; and said torsion spring assembly further comprises a control pin which is inserted into one of said bores and which abuts said upright projection to permit winding of said torsion spring when the door moves away from the closed position.

7. The door accessory as claimed in claim 4, further comprising a mounting unit for securing said cover panel to the door, said mounting unit including:

a first mounting panel provided with a row of openings and connected to said cover panel;

a second mounting panel spaced from a front side of said first mounting panel and similarly provided with a row of openings which are aligned with and which are smaller than said openings in said first mounting panel; and screws extending into aligned said openings in said first and second mounting panels to fasten said first and second mounting panels to the door.

8. The door accessory as claimed in claim 1, wherein said fluid receiving space has a bottom end and a top end and gradually widens from said bottom end to said top end.

9. A door accessory, comprising:

a hinge pin;

a stationary hinge leaf fixed to said hinge pin and adapted to be fixed to a door frame;

a rotatable hinge leaf rotatably mounted to said hinge pin and adapted to be fixed to a door;

a static gear mounted axially and being stationary relative to said hinge pin;

a torsion spring assembly mounted on said hinge pin and being wound when the door is moved from a closed position to an open position relative to the door frame so as to provide a force for automatically returning the door back to the closed position;

a rod driving unit including: a gear means meshing with and rotating in a first direction relative to said static gear when the door moves toward the open position and in a second direction when the door moves toward the closed position; a sheave rotated by said gear means; and a cable having one end connected to said sheave; and a hydraulic retarding device provided below said rod driving unit and including: a cylinder body confining a fluid receiving space to receive hydraulic fluid therein; a piston rod having a lower end extending into said fluid receiving space and an upper end connected to the other end of said cable; a compression spring biasing said piston rod inwardly into said cylinder body; a piston mounted on said piston rod inside said cylinder body and being formed with perforations, said piston forming a clearance with said cylinder body; and a valve ring loosely sleeved on said piston rod above said piston;

rotation of said gear means in the first direction causing said cable to unwind from said sheave and further causing said compression spring to expand and move said piston rod downward so that said hydraulic fluid flows through said clearance and through said perforations to separate said valve ring from said piston;

rotation of said gear means in the second direction causing said cable to wind on said sheave and further causing said piston rod to move upward, thereby causing said piston to move upward and said valve ring to block said perforations to permit said hydraulic fluid to flow only through said clearance so as to retard upward movement of said piston rod.

10. The door accessory as claimed in claim 9, wherein:

said gear means comprises an axle extending transverse to said hinge pin and a dynamic gear meshing with said static gear, said dynamic gear being mounted axially and being stationary relative to said axle; and said rod driving unit further comprises a guide seat which defines an upright receiving space, said sheave being rotatably provided in said upright receiving space and being mounted axially and being stationary relative to said axle.

11. The door accessory as claimed in claim 10, wherein said gear means further comprises a T-shaped tubular connector having an upright tube portion and a transverse tube portion which extends from said upright tube portion, said hinge pin extending through said upright tube portion, said axle having one end extending into said transverse tube portion.

12. The door accessory as claimed in claim 10, wherein:

said guide seat has an open top end;

said door accessory further comprises a horizontally extending cover panel adapted to be fixed to the door, said cover panel being mounted on said open top end of said guide seat and being longer than the width of said guide seat, said cover panel being formed with an opening to permit said hinge pin to extend therethrough, said cover panel being disposed between said torsion spring assembly and said static gear.

13. The door accessory as claimed in claim 12, wherein said torsion spring assembly comprises:

a rotatable collar mounted axially on said hinge pin and rotating with said cover panel relative to said hinge pin when the door is moved;

a stationary collar mounted axially on said hinge pin and being stationary relative to said hinge pin; and a torsion spring surrounding a portion of said hinge pin between said stationary and rotatable collars, said torsion spring having a first end connected to said stationary collar and a second end connected to said rotatable collar;

whereby, said torsion spring is wound when said cover panel and said rotatable collar move with the door away from the closed position.

14. The door accessory as claimed in claim 13, wherein:

said rotatable collar is a cylindrical body which is formed with a plurality of radially extending and angularly spaced bores;

said cover panel is provided with an upright projection adjacent to said rotatable collar; and said torsion spring assembly further comprises a control pin which is inserted into one of said bores and which abuts said upright projection to permit winding of said torsion spring when the door moves away from the closed position.

15. The door accessory as claimed in claim 12, further comprising a mounting unit for securing said cover panel to the door, said mounting unit including:

a first mounting panel provided with a row of openings and connected to said cover panel;

a second mounting panel spaced from a front side of said first mounting panel and similarly provided with a row of openings which are aligned with and which are smaller than said openings in said first mounting panel; and screws extending into aligned said openings in said first and second mounting panels to fasten said first and second mounting panels to the door.

* * * * *